US009315287B2

(12) United States Patent
Wintermute et al.

(10) Patent No.: US 9,315,287 B2
(45) Date of Patent: Apr. 19, 2016

(54) PREASSEMBLED DISPLAY WITH AUTOMATIC STACKABLE SUPPORTS

(71) Applicant: Mars, Incorporated, McLean, VA (US)

(72) Inventors: William Wintermute, Hackettstown, NJ (US); David Schoettle, Lititz, PA (US); Stan Clifford, Easton, PA (US)

(73) Assignee: MARS, INCORPORATED, McLean, VA (US)

( * ) Notice: Subject to any disclaimer, the term of this patent is extended or adjusted under 35 U.S.C. 154(b) by 138 days.

(21) Appl. No.: 13/914,859

(22) Filed: Jun. 11, 2013

(65) Prior Publication Data

US 2014/0014713 A1 Jan. 16, 2014

Related U.S. Application Data

(60) Provisional application No. 61/669,833, filed on Jul. 10, 2012.

(51) Int. Cl.

| | |
|---|---|
| ***B65D 5/50*** | (2006.01) |
| ***B65D 5/44*** | (2006.01) |
| ***B65D 5/00*** | (2006.01) |

(52) U.S. Cl.

CPC ..... *B65D 5/0015* (2013.01); *B65D 5/001* (2013.01); *B65D 5/445* (2013.01); *B65D 5/5054* (2013.01); *Y10T 156/1049* (2015.01)

(58) Field of Classification Search

CPC ..... B65D 5/445; B65D 5/001; B65D 5/0075; B65D 5/005; B65D 5/5054

USPC ..... 229/122.32, 122.33, 199, 918

See application file for complete search history.

(56) References Cited

U.S. PATENT DOCUMENTS

| | | | | |
|---|---|---|---|---|
| 3,007,622 | A | 11/1961 | George | |
| 4,834,255 | A * | 5/1989 | Boots | 229/199 |
| 5,016,753 | A | 5/1991 | Henderson | |
| 5,125,568 | A | 6/1992 | Bauer | |
| 5,377,587 | A | 1/1995 | Kobler | |
| 5,505,368 | A | 4/1996 | Kanter et al. | |
| 5,779,136 | A | 7/1998 | Blazquez Garcia | |
| 5,957,294 | A | 9/1999 | Kanter | |
| 5,961,035 | A | 10/1999 | Correll | |
| 5,988,491 | A * | 11/1999 | Morrison | 229/122.32 |
| 6,158,653 | A | 12/2000 | Kanter et al. | |
| 6,189,780 | B1 | 2/2001 | Kanter | |
| 6,325,282 | B1 | 12/2001 | Kanter et al. | |
| 6,712,214 | B1 | 3/2004 | Wintermute et al. | |
| 6,786,394 | B2 * | 9/2004 | Prince | 229/117.3 |
| 6,817,514 | B2 | 11/2004 | Kanter et al. | |
| 6,874,679 | B2 | 4/2005 | Tibbles et al. | |
| 7,484,654 | B2 | 2/2009 | Tibbles et al. | |

(Continued)

FOREIGN PATENT DOCUMENTS

| | | |
|---|---|---|
| EP | 1746035 | 4/2010 |
| FR | 2794681 | 6/1999 |

*Primary Examiner* — Gary Elkins

(74) *Attorney, Agent, or Firm* — Mars, Incorporated; Amy Fernandez

(57) ABSTRACT

A preassembled display with automatic stackable supports (PDASS) is described. A PDASS may include two or more blanks (for example pieces of corrugated paperboard) that are joined together, for example to initially form a knocked down flat (KDF). The PDASS may include an insert formed from a single blank, where the single insert blank, when the whole display is erected, automatically erects and provides asymmetric supports that form at opposing corners of the outer blank.

29 Claims, 8 Drawing Sheets

(56) References Cited

U.S. PATENT DOCUMENTS

| | | | | |
|---|---|---|---|---|
| 7,981,017 | B2 | 7/2011 | Little et al. | |
| 8,091,770 | B2 * | 1/2012 | McLeod | 229/143 |
| 8,177,117 | B2 * | 5/2012 | Little | 229/120.18 |
| 8,297,490 | B2 * | 10/2012 | Little et al. | 229/122.32 |
| 2005/0161495 | A1 | 7/2005 | Shepherd | |
| 2010/0234201 | A1 | 9/2010 | Little et al. | |
| 2010/0288670 | A1 | 11/2010 | Tibbels et al. | |

* cited by examiner

PREASSEMBLED DISPLAY WITH AUTOMATIC STACKABLE SUPPORTS

FIELD OF THE INVENTION

One or more embodiments of the present disclosure relate to a display with stackable supports. More specifically, one or more embodiments relate to a preassembled display that includes a single insert blank that automatically forms stackable supports when an outer blank is erected.

BACKGROUND

Flat sheets of corrugated paperboard, sometimes referred to as blanks, have been used for many years as the starting material to form containers. Corrugated paperboard generally refers to a multi-layer sheet material comprised of two sheets of liner bonded to a central corrugated layer. Containers formed from corrugated paperboard are sometimes referred to as corrugated boxes. Over ninety percent of all goods in most developed countries are shipped in corrugated boxes.

One style of corrugated box is the slotted box style. Slotted boxes may be formed from one or more pieces of corrugated paperboard (blanks). A blank may include portions that will form sides (including side panels and end panels) of a box as well as one or more sets of flaps, for example flaps that may form the top and/or bottom of the box. A blank may be scored and slotted to permit folding and/or erecting. A blank that has been erected into a box may form a joint at the point where one side panel and one end panel of the blank and/or box are brought together.

Boxes may be shipped flat (not erected) to a user. When a box is needed, a box user may erect (fold and/or "square up" and/or open) the box, insert product into the box and close any top flaps. A half slotted container (HSC) is a style of slotted container that may include a single set of flaps, for example flaps that form the bottom of the container. An HSC may have an open top and/or no top flaps.

DETAILED DESCRIPTION

One or more embodiments of the present disclosure describe a preassembled display with automatic stackable supports that addresses a number of disadvantages of prior stackable displays. One disadvantage of prior displays is that they are labor intensive and/or difficult to manufacture and assemble. Another disadvantage of prior displays is that they may require excessive materials and/or, in some cases, extraneous components to secure separate pieces of the container.

The present disclosure describes a preassembled display with automatic stackable supports (PDASS). A PDASS may be a custom-designed container (for example, an HSC) including two or more blanks (for example pieces of corrugated paperboard) that are joined together, for example to initially form a knocked down flat (KDF). The PDASS may include an insert formed from a single blank, where the single insert blank, when the whole display is erected, automatically provides supports at opposing corners of the outer blank. In some embodiments, one or more opposing supports may be asymmetrically shaped. The PDASS is designed to enable the KDF to be erected and automatically form stackable supports, resulting in a finished container that includes supports that act as corner "posts" of sorts. The supports and/or corner posts provide support to similar containers that may be stacked upon the immediate container.

Figure 1:
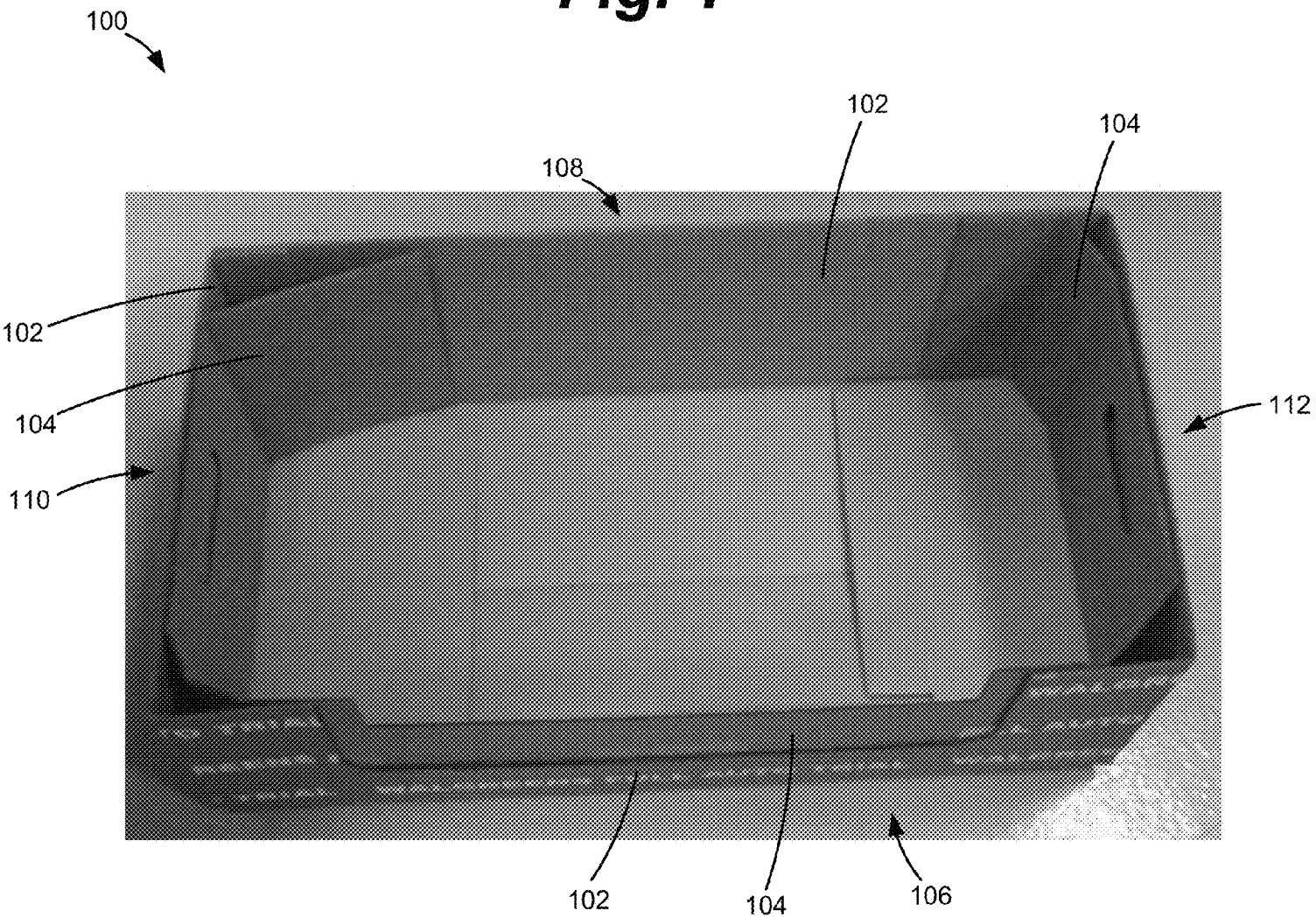
FIG. 1 depicts an illustration of a top angled view of an example preassembled display with automatic stackable supports, in accordance with one or more embodiments of the present disclosure.

FIG. 1 depicts an illustration of a top angled view of an example preassembled display with automatic stackable supports (PDASS) 100, in accordance with one or more embodiments of the present disclosure. PDASS 100 may include a number of blanks, for example an outer blank 102 and an insert blank 104. Outer blank 102 may include a number of panels, for example a front panel 106, a rear panel 108 and two side panels 110, 112. Insert blank 104 may also include a number of panels. When PDASS 100 is fully erected, the insert blank 104 may nest or wrap inside the outer blank 102 such that the insert blank substantially abuts the inside of the outer blank. For example, the outer surface of a number of the panels of the insert blank 104 may abut portions of the inside surface of the panels of the outer blank, as shown in FIG. 1. In some examples, the insert blank may nest or wrap along less than the entire inside of the outer blank (best shown in FIG. 3B). In other words, the insert blank may be a partial insert blank. Portions of the insert blank panels may be adhered to portions of the outer blank panels. For example, glue, tape or other adhesive (for example fast curing and/or slow curing adhesives) may reside between the insert blank and the outer blank, for example where the adhesive touches portions of the outer surface of a number of the panels of the insert blank and touches portions of the inside surface of the panels of the outer blank.

Figure 2A:
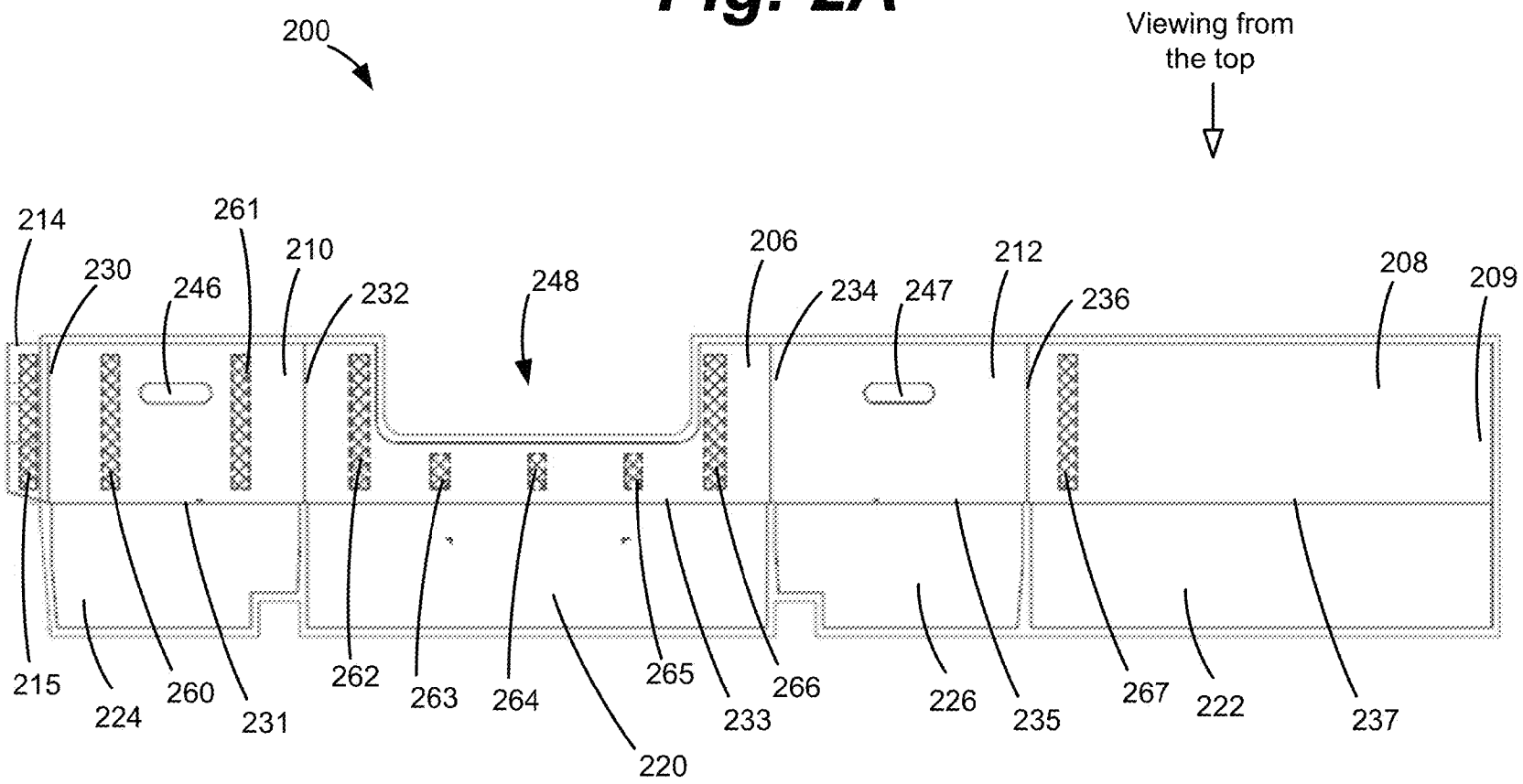
FIG. 2A depicts an illustration of a side schematic view of a flattened outer blank of an example preassembled display with automatic stackable supports, in accordance with one or more embodiments of the present disclosure.

FIG. 2A depicts an illustration of a side schematic view of a flattened outer blank 200 of an example preassembled display with automatic stackable supports (PDASS), in accordance with one or more embodiments of the present disclosure. Outer blank 200 may be substantially similar to outer blank 102 of FIG. 1. Outer blank 200 may include a number of panels, for example a front panel 206, a rear panel 208, two side panels 210, 212 and a connection panel 214. Outer blank 200 may include a number of flaps, for example a front flap 220, a rear flap 222 and two side flaps 224, 226. Each panel and flap may include an inside surface and an outside surface, such surfaces forming inside and outside surfaces of blank 200. In the example shown in FIG. 2A, outside surfaces may face the viewer of the illustration, and inside surfaces (surfaces that face the center of the erected box) may face away from the viewer of the illustration. Outer blank 200 may include one or more handles 246, 247, each handle defined by an edge of a panel that encircles, for example in an oval shape, an empty space.

Outer blank 200 may include a window and/or cutout 248 defined by an edge of panel 206 that curves downward from the top, curves horizontal, and then curves upward back to the top of panel 206. In some embodiments, the outer blank and/or the inner blank may be adapted to stabilize the window and/or cutout 248, for example during use when a portion of the outer blank is removed to form window 248. If the outer blank and/or the insert blank are not adapted to stabilize the window and/or cutout 248, additional pressure may be exerted on front panel 220, for example when the PDASS is erected and filled with product. In some embodiments, one or more adhesive zones of outer blank 200 (for example, adhesive zone 264) may be adhered to one or more zones of the insert blank to provide stabilization and/or support to the window 248. In other embodiments, the insert blank may be adapted to include a bottom flap 328. This bottom flap may stabilize the window 248 and may be used in conjunction with one or more adhesive zones of outer blank 200.

Outer blank 200 may be partially erected into a KDF, or a portion thereof, by folding and/or creasing panels 206, 208, 210, 212, 214 at joints 230, 232, 234, 236, such that a substantially right angle exists at each joint, formed by the panels on either side of the joint. Joints 230, 232, 234, 236 may be scored, perforated and/or slotted to permit easy folding and/or erecting. It should be understood that even though FIG. 2A may show one or more of the joints as being scored and/or perforated, different embodiments may utilize an outer blank with different combinations of joint types (scored, perforated, slotted, etc.). For example, an outer blank may include joints that are all scored or all perforated. Alternatively, an outer blank may include some joints that are perforated, some that are scored and optionally some that are of a different type. Different types of joints (scoring, perforating, etc.) may adapt the outer blank to provide the appropriate pressure against the insert blank during and/or after erection of the carton. Once the panels of the outer blank have been folded to form substantially right angles at joints 230, 232, 234, 236, end 209 of panel 208 may meet and overlap with connection panel 214. End 209 may be adhered to connection panel 214, for example with glue, tape or other adhesive (for example fast curing and/or slow curing adhesives) residing at the adhesive zone 215. At this point, when viewed from the top (viewing angle can be seen in FIGS. 2A and 2B), the partially erected outer blank may substantially resemble a rectangle 240, with the panels appearing as lines or edges of the rectangle and the joints appearing as corners of the rectangle.

Figure 2B:
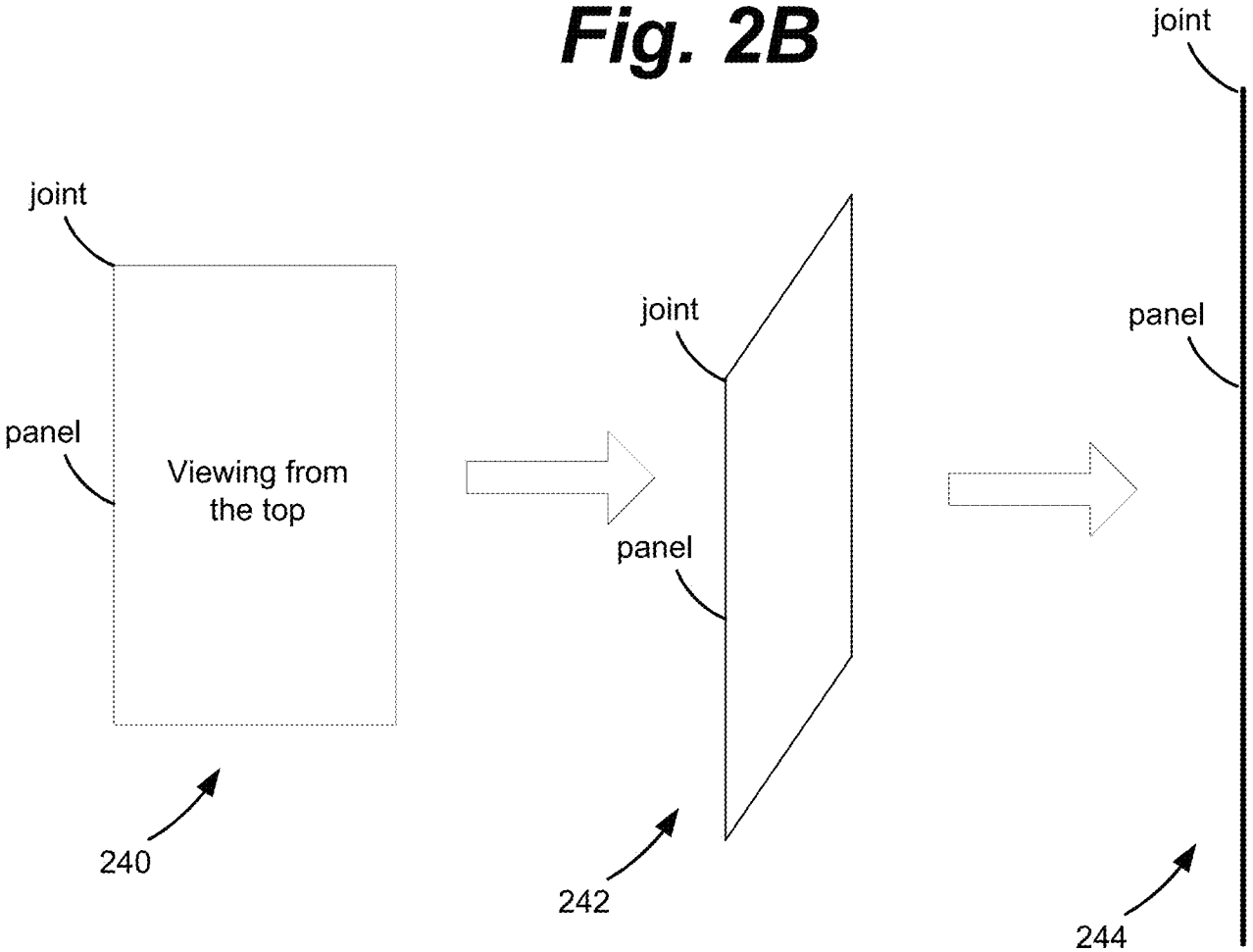
FIG. 2B depicts an example display knock down process, in accordance with one or more embodiments of the present disclosure.

A partially erected outer blank may then be "knocked down" to form a KDF, or a portion thereof. FIG. 2B depicts the knock down process. By creasing some joints completely and allowing other joints to return to (or remain in) an unfolded orientation, the outer blank, when viewed from the top may substantially resemble a parallelogram 242, and then substantially resemble a line 244. At this point the outer blank is configured as a KDF, meaning it is partially assembled in a substantially flat configuration. This configuration may adapt a partially erected container for easy stacking, storing and/or shipping. Later, a consumer goods manufacturer may erect a KDF into a container that is adapted to hold goods. It should be understood that a KDF may be created by folding and/or creasing a blank at all of the joints to form a rectangle, and then collapsing the rectangle, for example like the process shown in FIG. 2B. Alternative, a KDF may be created by refraining from creasing some joints and fully creasing other joints such that the blank is constructed directly into the substantially flat configuration. A KDF may include more than one blank, and the folding required to create the KDF may occur before or after multiple blanks have been adhered together. In one example, an insert blank is adhered to an outer blank before the outer blank is folded to create a KDF.

Referring to FIG. 2A, and assuming blank 200 has already been partially erected by folding the panels, outer blank 200 may be fully erected by folding and/or creasing flaps 220, 222, 224, 226 at joints 231, 233, 235, 237 such that a substantially right angle exists at each joint, formed by the flap and panel and on either side of the joint. Blank 200 may be fully erected from a KDF with unfolded flaps 220, 222, 224, 226, or it may be fully erected from an unfolded blank, such as the one depicted in FIG. 2A. In one example, panels 206, 208, 210, 212 are folded and adhered at adhesive zone 215 before flaps 220, 222, 224, 226 are folded. In this example, when the flaps are folded, each flap may partially overlap one or more of the other flaps. Flaps may be adhered to each other with glue, tape or other adhesive (for example fast curing and/or slow curing adhesives). Alternatively, each flap may hold in place by interlocking with other flaps.

In one example, an insert blank may be adhered to an outer blank and a KDF may be assembled on a different machine than the machine that erects the KDF to form a box. In this respect, a KDF comprising the insert blank may be formed in one event, perhaps at one location, and the KDF may be opened, erected, filled, closed and/or sealed as a separate event, perhaps at a different location. In a commercial example, a carton supplier may create a KDF, including the insert blank, and ship it to a consumer goods manufacturer, where the consumer goods manufacturer may open, erect, fill, close, seal and/or ship the carton filled with product. Having the KDF preassembled may allow a consumer goods manufacturer to utilize the same carton erecting machines that they already utilize for cartons without automatic stackable supports and/or inserts. In another example, the insert blank may be adhered to the outer flat and the KDF may be assembled on the same machine (and perhaps at the same location) that erects the box.

Figure 3A:
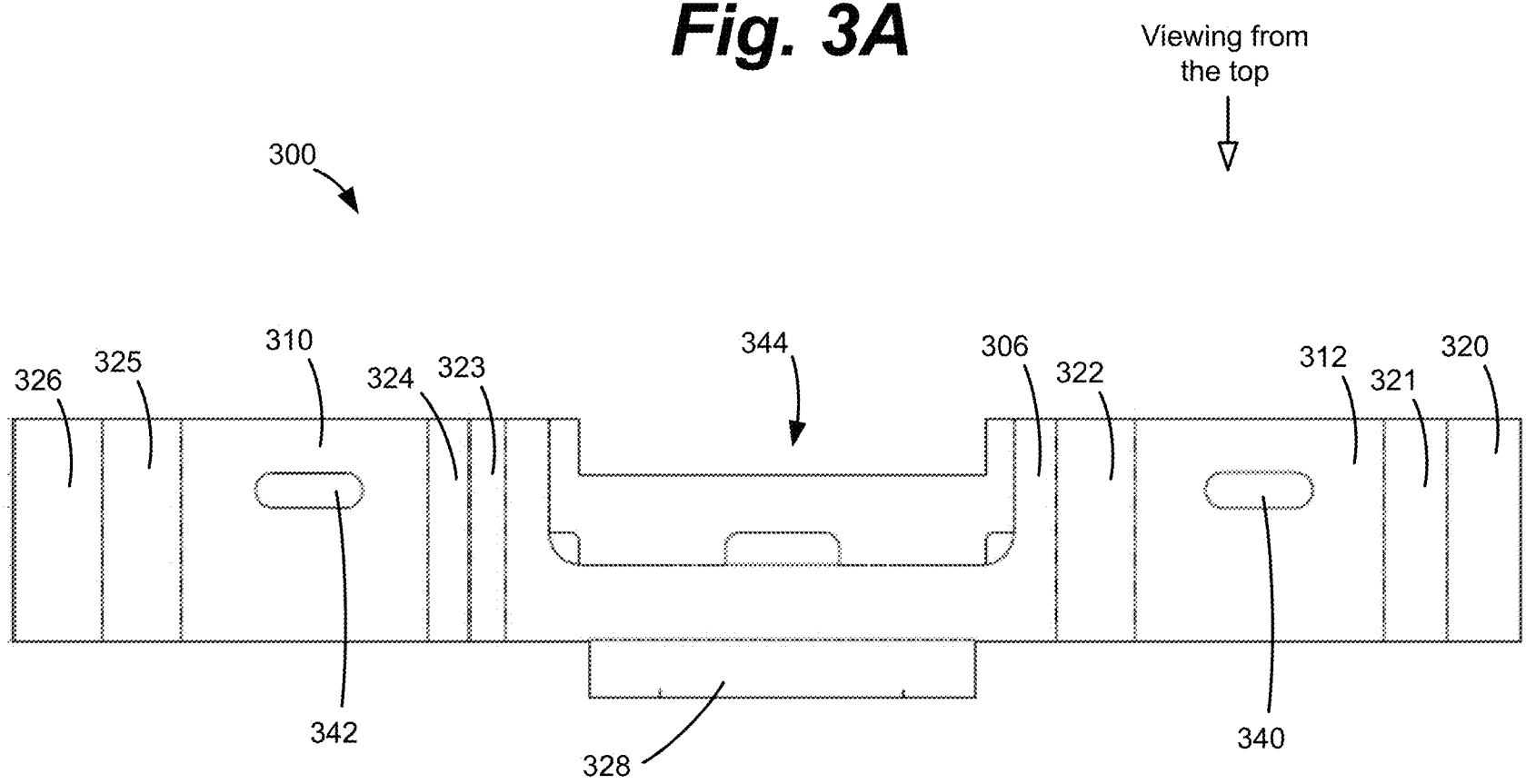
FIG. 3A depicts an illustration of a side schematic view of a flattened insert blank of an example preassembled display with automatic stackable supports, in accordance with one or more embodiments of the present disclosure.

FIG. 3A depicts an illustration of a side schematic view of a flattened insert blank 300 of an example preassembled display with automatic stackable supports (PDASS), in accordance with one or more embodiments of the present disclosure. Insert blank 300 may be substantially similar to insert blank 104 of FIG. 1. Insert blank 300 may include a number of panels, for example a front panel 306, two side panels 310, 312 and a number of support panels 320, 321, 322, 323, 324, 325, 326. Insert blank 300 may include a number of flaps, for example a bottom flap 306. Each panel and flap may include an inside surface and an outside surface, such surfaces forming inside and outside surfaces of blank 300. In the example shown in FIG. 3A, outside surfaces (surfaces that abut the outer blank) may face the viewer of the illustration, and inside surfaces (surfaces that face the center of the erected box) may face away from the viewer of the illustration. Insert blank 300 may include one or more handles 340, 342, each defined by an edge of a panel that encircles, for example in an oval shape, an empty space. Outer blank 200 may include a window or cutout 344.

One or more embodiments of the present disclosure may use a single insert blank (formed from a single piece of corrugated paperboard), as opposed to multiple-piece inserts of existing containers. The single insert blank can be seen in FIGS. 3A and 3B. One benefit of a single insert blank may be that a KDF with a single insert blank may be easier to manufacture and to assemble into a KDF with an outer blank. For example, a single insert blank can be automated manufactured and assembly into a KDF with an outer blank can likewise be automated. Another benefit of a single insert blank may be that the KDF may flatten down more uniformly and flatter than multi-part inserts. Another benefit of a single insert blank may be that the KDF may erect more reliably, without binding and/or crushing. Another benefit may be that a single insert blank works more reliably together with an outer blank, for example the interaction between adhered panels, un-adhered panels and/or scored and/or perforated joints, such that acceptable pressure is applied by the insert blank against the outer blank, as described more herein.

Figure 3B:
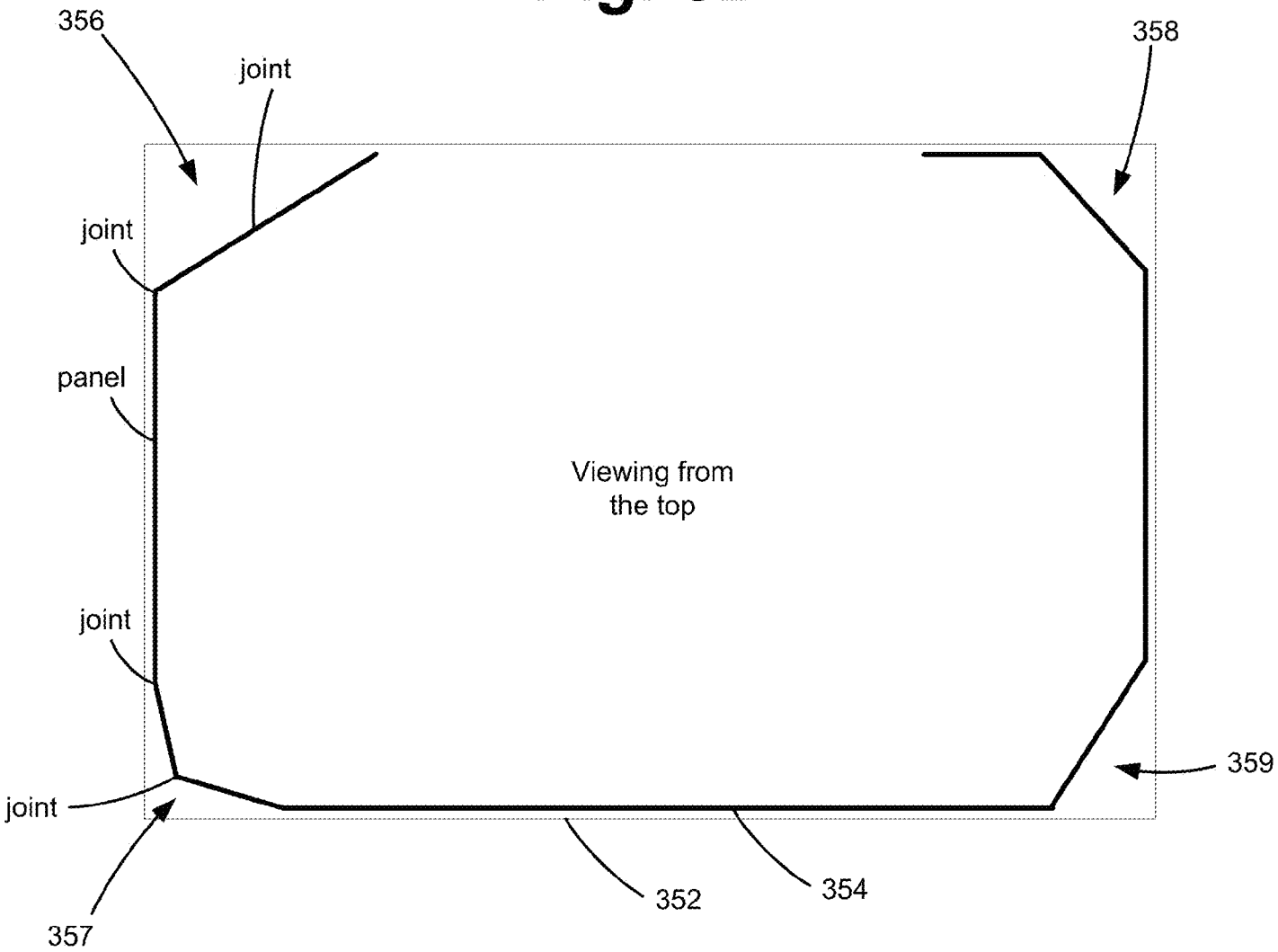
FIG. 3B depicts a top view of an example erected and/or folded insert blank nested inside of an example erected and/or folded outer blank, in accordance with one or more embodiments of the present disclosure.

Insert blank 300 may be partially erected in a similar manner to the outer blank 200 of FIG. 2. The panels of the inner blank may be folded and/or creased at horizontal joints. Joints may be scored, perforated and/or slotted to permit easy folding and/or erecting. It should be understood that even though FIG. 3A may show one or more of the joints as being perforated and/or scored, different embodiments may utilize an insert blank with different combinations of joint types (scored, perforated, slotted, etc.). For example, an insert blank may include joints that are all scored or all perforated. Alternatively, an insert blank may include some joints that are perforated, some that are scored and optionally some that are of a different type. Different types of joints (scoring, perforating, etc.) may adapt the insert blank to provide the appropriate pressure against the outer blank during and/or after erection of the carton. In some configurations, joints may form angles other than right angles, as can be seen in FIG. 3B. FIG. 3B shows a top view of an erected and/or folded insert blank 352 nested or wrapped inside of an erected and/or folded outer blank 352, similar to the configuration depicted in FIG. 1. In some examples, the insert blank may nest or wrap along less than the entire inside of the outer blank (best shown in FIG. 3B). In other words, the insert blank may be a partial insert blank. As can be seen in FIG. 3B, a variety of angles may form at the joints when an insert blank 354 is nested or wrapped inside of an erected outer blank 352. An insert blank may be partially erected by folding the panels at joints and then inserting the insert blank inside of an erected outer blank. Alternatively, an insert blank may be partially erected by adhering the insert blank to an outer blank and then partially erecting the outer blank as described herein. In other embodiments, the insert blank may be adhered to an outer blank before the outer blank is folded to create a KDF.

Referring to FIG. 3B, an erected insert blank 354 inside of an erected outer blank 352 may form corners or supports 356, 357, 358 and 359. In some embodiments, when the whole display (i.e., a KDF including an insert blank adhered to an outer blank) is erected, the corners or supports may extend substantially the entire height of the outer blank. Insert blank 354 may form two sets of diagonally opposing corners or supports, for example diagonally opposing corners 357 and 358 and diagonally opposing corners 356 and 359. In some embodiments, insert blank 354 may form less than four corners or supports, for example with two diagonally opposing corners and one additional corner without a diagonally opposing partner corner.

In some embodiments, insert blank 354 may form one or more sets of diagonally opposing corners or supports. Diagonally opposing corner supports may be asymmetrically shaped when the two corners of the set are compared to each other. In some embodiments, all (i.e., three or four) of the corner supports may be asymmetrically shaped when compared to each other. When the whole display (i.e., a KDF including an insert blank adhered to an outer blank) is erected, asymmetric corners or corner posts or stackable supports may be automatically created. Corners of the insert blank may include different numbers of support panels, the support panels may be differently sized and/or the angles at the joints near the support panels may be different. As one example, corner 356 of insert blank 354 may include two support panels that are oriented in a substantially straight line, whereas corner 359 may include one support panel where unequal angles exist between the support panel and adjacent side and front panels.

One benefit of asymmetric corners and/or supports may be to allow the KDF to easily and reliably fold flat and/or erect. In some existing containers, for example with symmetrical corners, there is too much material (i.e., "bulk") in the corners, and when the container gets folded to form a KDF, the bulk in the corners may prevent the container from being flat. If the container cannot fold to become a flat enough KDF, the KDF may not work efficiently with automatic erecting equipment designed to erect simple, one-part boxes. Asymmetric corners and/or supports may be to allow the KDF to fold flatter, and may allow efficiencies, for example in storing and shipping the KDF's. Asymmetric corners and/or supports may also allow the KDF's to be loaded properly into the automatic erecting equipment and/or machines, for example erecting equipment designed to erect simple, one-part boxes.

Referring to FIGS. 2A and 3A as an example, an inner blank 300 may be adhered to an outer blank 200. For example glue, tape or other adhesive (for example fast curing and/or slow curing adhesives) may reside between a portion of the inside surface of the outer blank and a portion of the outer surface of the insert blank. Referring to FIG. 2A, adhesive may reside at adhesive zones 260, 261, 262, 263, 264, 265, 266, 267, which are located on the inside surfaces of outer blank 200. Outer surfaces of insert blank 300 may contact adhesive zones 260, 261, 262, 263, 264, 265, 266, 267. For example, adhesive zones 260, 261 may contact panel 310 of insert blank 300, adhesive zones 260, 261, 262, 263, 264, 265, 266 may contact panel 306, and adhesive zone 267 may contact panel 312. In this respect, insert panel 300 may adhere tightly to outer blank, at least at the adhesive zones, for example as can be seen in FIG. 1.

The adhesive used to adhere the insert blank to the outer blank (for example at adhesions zones 260, 261, 262, 263, 264, 265, 266, 267) may be selected from a variety of adhesives depending on the adhesive properties desired and perhaps the location of the blank at which the adhesive is applied. In some embodiments, a fast curing type of adhesive may be used that cures and bonds quickly during the KDF forming process, for example to stabilize the two blanks during the KDF forming/folding process. In one example, the fast curing adhesive may substantially bond before the blanks are folded to create the KDF. On example of a fast curing adhesive is a hot melt adhesive. In some embodiments, a slow curing type of adhesive may be used that cures more slowing and delays bonding, for example until after the KDF is formed. For example, slow curing adhesives may allow time for folding before the adhesive sets, for example so that the blanks can move relative to each other during folding and then have all adhesion points be secure before the erection process begins. One example of a slow curing adhesive is a cold melt adhesive. In some embodiments, more than one type of adhesive may be used, for example both fast curing and slow curing adhesives. In some examples, the fast curing adhesive may be used at locations on the inside surface of the outer blank, for example where it may be desirable to have little or no movement of the outer blank relative to the insert blank. In some examples, the slow curing adhesive may be used at locations on the inside surface of the outer blank, for example where it is desirable to have some movement of the outer blank relative to the insert blank. Movement between the outer blank and insert blank can occur when the adhered blanks are folded to form the KDF, for example. In some specific examples, the fast curing adhesive is used at adhesion zones 262, 263, 264, 265, and 266. In some specific examples, the slow curing adhesive is used at adhesion zones 260, 261, and 267.

Adhesive placement (the location on the blanks where adhesive is applied) may determine how the KDF may move during the erecting process. Some panels of the outer and insert blank may have adhesive applied to them and other panels may not. For example, insert panels 326, 325, and 312 may not have adhesive applied to them and these panels may not be directly adhered to the outer blank. One benefit of some panels of the insert blank not being adhered to the outer blank is that they may move, relative to panels of the outer blank, when the KDF is erected. Adhered panels, un-adhered panels and/or scored and/or perforated joints of the insert and outer blanks may all work together during the formation and/or erection of the carton, for example such that acceptable pressure is applied by the adhered panels of the insert blank against the outer blank. One advantage of the present disclosure is that the insert blank may be a partial insert blank (best seen in FIG. 3B where the insert blank wraps less than all the way around the inner surfaces of the outer blank). A partial insert blank in conjunction with the adhered panels, un-adhered panels and/or scored and/or perforated joints described above may create an insert blank that reliably moves within the outer blank such that KDFs may reliably be flattened and/or erected without binding and/or crushing of parts of the KDF. Additionally, a partial insert blank may allow the KDF to be folded flat enough such that the KDF works efficiently with automatic erecting equipment designed to erect simple, one-part boxes.

An insert blank may be adhered to an outer blank before or after the outer blank has been partially or fully erected. In one example, an insert blank may be adhered to an outer blank before the outer blank has been partially or fully erected. In this respect the insert bank and the outer blank may both be flat and unfolded when the insert blank is adhered. Then, as the outer blank is erected, the insert blank may be automatically erected, and may automatically form corner supports.

In other embodiments, an insert blank may be adhered to an outer blank before the KDF is folded. In such embodiments, the insert bank and the outer blank may both be flat and unfolded when the insert blank is adhered. Then, as the KDF is folded and panels of the outer blank are adhered, the insert blank and outer blank are simultaneously folded to form a substantially flat KDF.

An outer blank and insert blank may be erected together. For example, erecting an outer blank, as explained above, may automatically erect the insert blank because the insert blank may have joints and because the insert blank may be adhered to the outer blank at strategic adhesion zones. The joints and the strategic adhesion zones may adapt a KDF to automatically force the insert blank into an erected configuration at the same time the outer blank is erected. For example, the outer blank may pull and/or push the insert blank at the strategic adhesion zones, forcing it to erect. A machine may be utilized to erect and/or open a KDF that includes an insert blank adhered to an outer blank at strategic adhesion zones. The machine may hold in place one panel of the KDF while moving another panel of the KDF such that the substantially flat KDF transforms into a partially erected container that resembles a rectangle when viewed from the top. The machine may fold and/or close the bottom flaps of the outer blank until the bottom flaps are substantially perpendicular to the side panels. The machine may cause the bottom flaps to interlock or adhere to each other. In some embodiments, the bottom flaps do not interlock or adhere and instead, tape may be applied to create a closed bottom for the container. The folding of the bottom flaps of the outer blank may cause one or more flaps (for example, bottom flap 328 of FIG. 3A) of the insert blank, to the extent they exist, to fold into place as well. In some embodiments, one or more zones of the insert blank (for example bottom flap 328 of insert blank 300 in FIG. 3) may provide stabilization and/or support to the window 248. The resulting container may be fully erected and ready to be filled with product.

Fully erected containers may be placed in retail stores as production displays or display trays, for example to display consumer goods. Fully erected containers may be shipped in a fully erected configuration, for example packed full of consumer goods. Erected containers may have covers placed over them at times, for example during shipment. In some examples, when a container with a cover arrives at the retailer location, the cover may be removed, and the display tray may be displayed in the store, showing the consumer goods. In some situations, fully erected contains may be built into multi-container display pallets for use in retail merchandising.

Figure 4A:
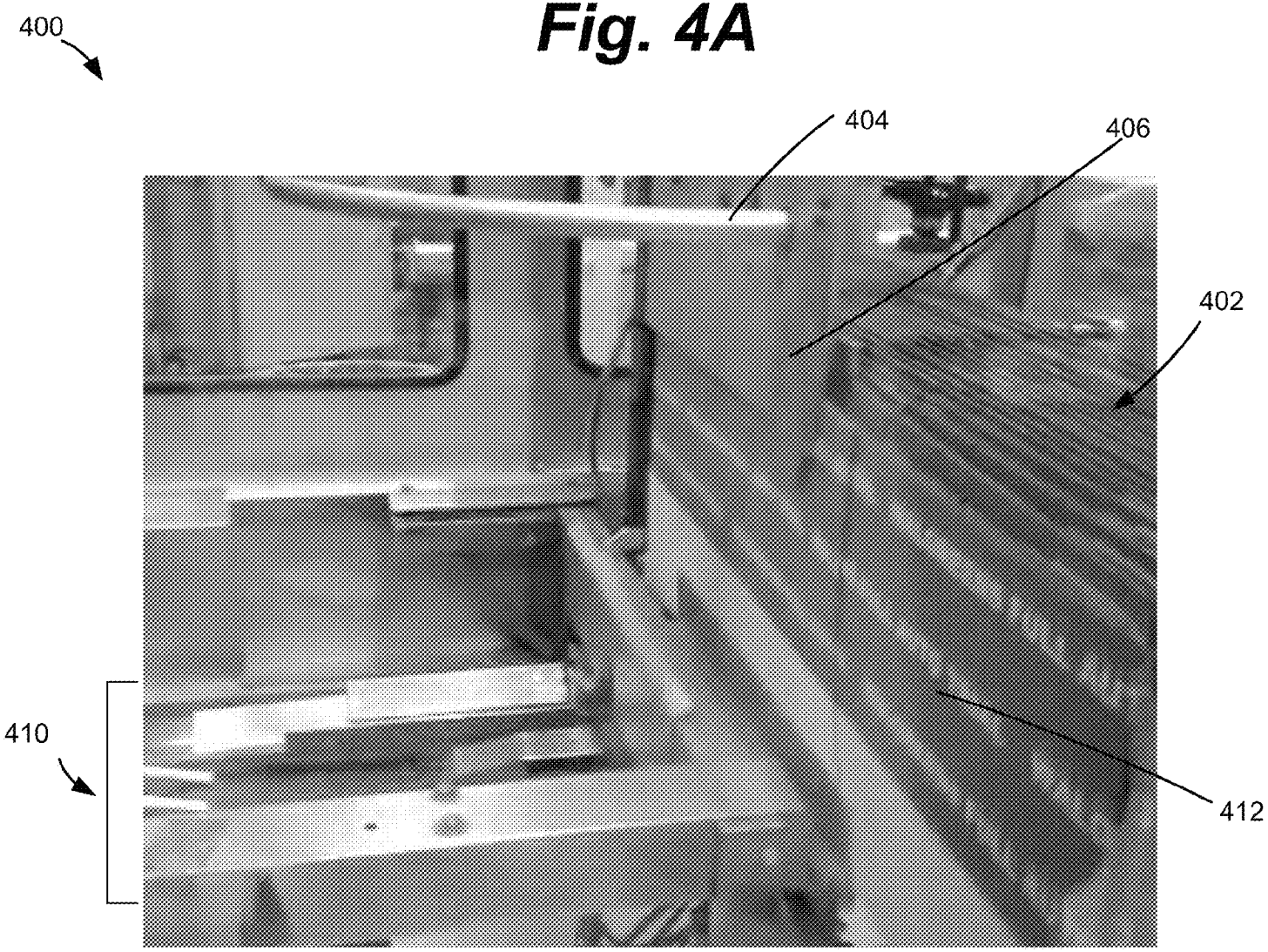
FIG. 4A depicts an illustration of an example container erecting machine, in accordance with one or more embodiments of the present disclosure.
Figure 4B:
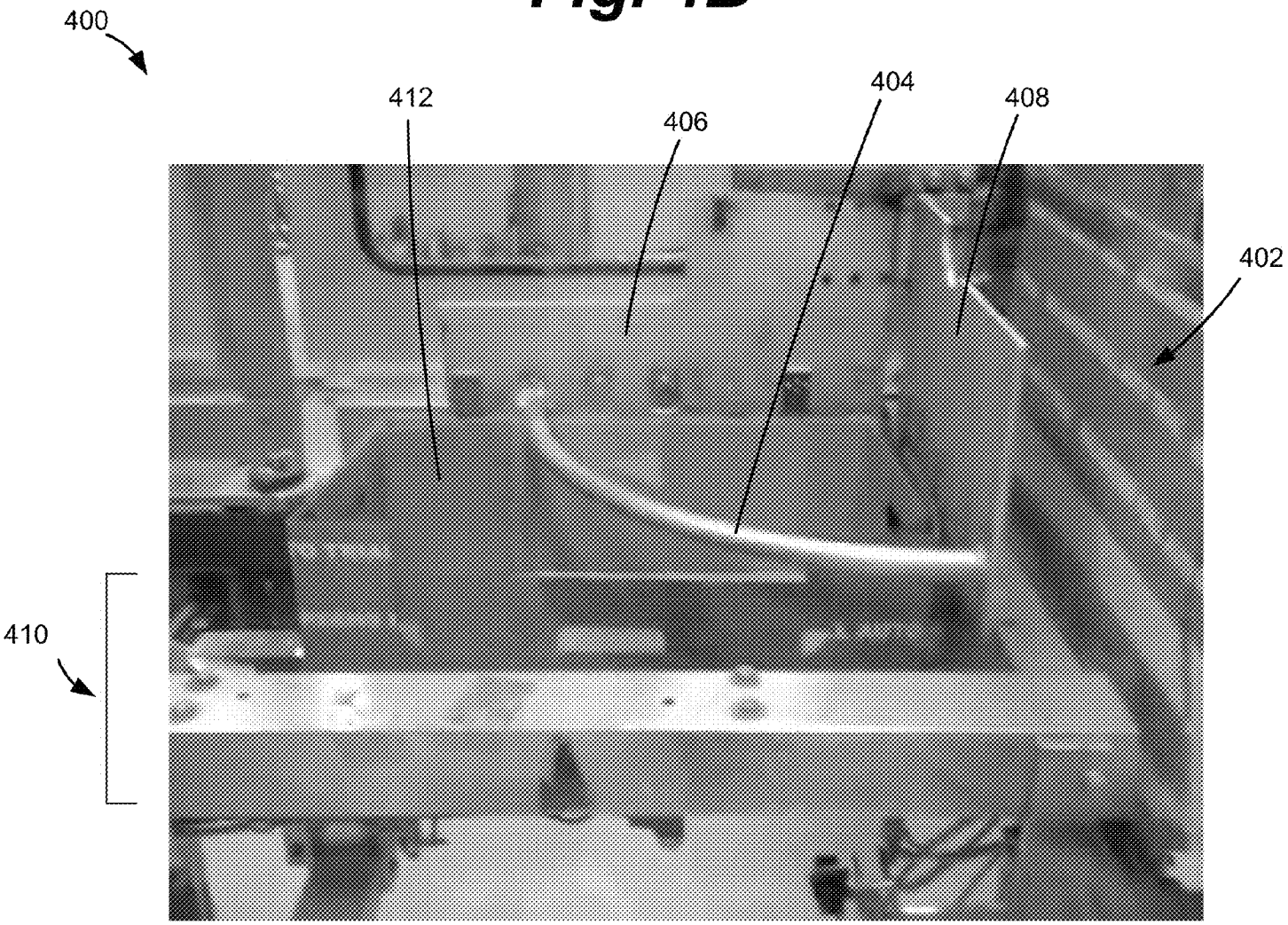
FIG. 4B depicts an illustration of an example container erecting machine, in accordance with one or more embodiments of the present disclosure.
Figure 4C:
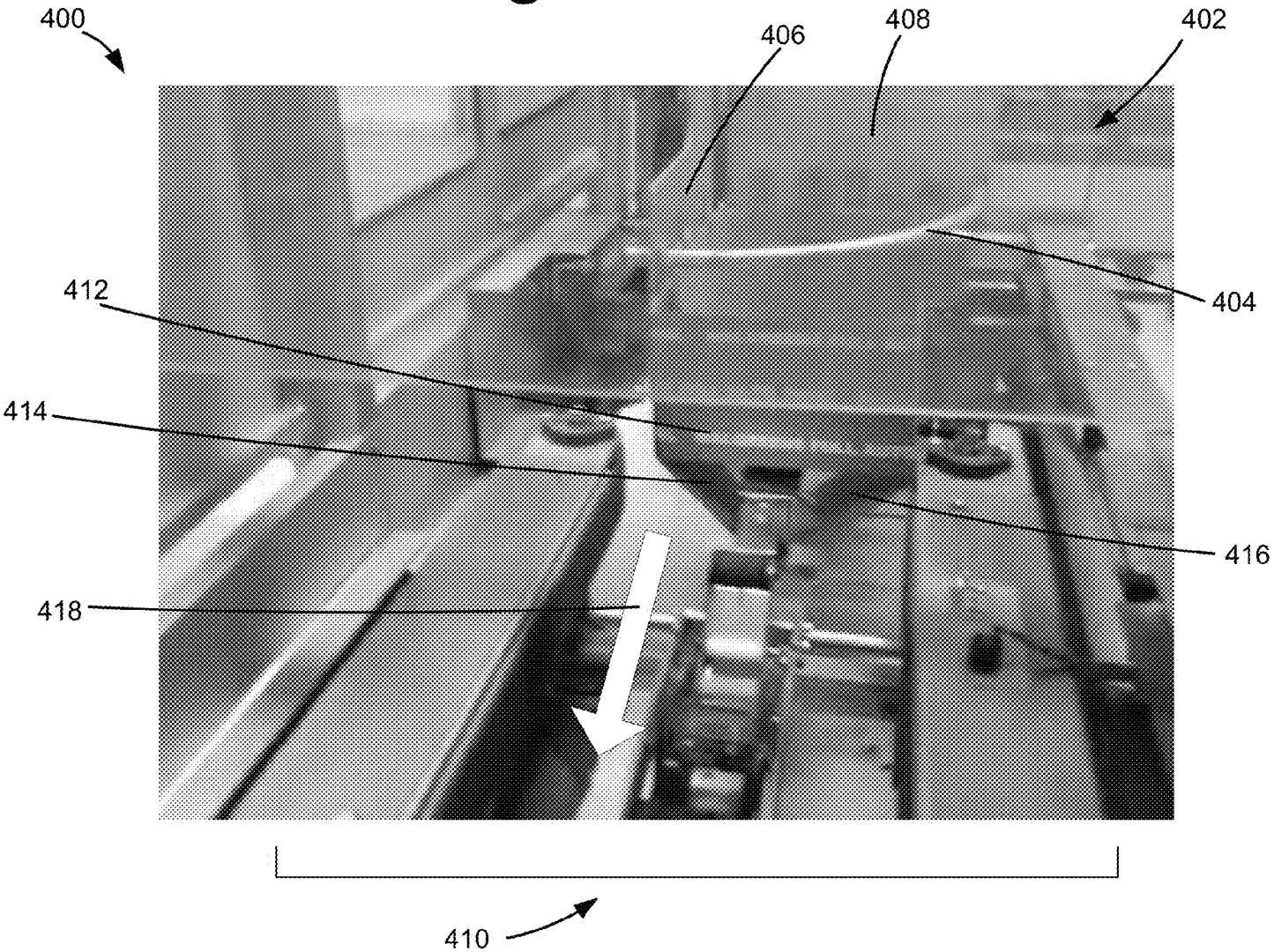
FIG. 4C depicts an illustration of an example container erecting machine, in accordance with one or more embodiments of the present disclosure.

FIGS. 4A-4C depict illustrations of an example container erecting machine 400 that may be operable to erect one or more KDFs, for example from a stack of KDFs 402. The KDFs depicted in stack 402 may be substantially similar to the KDFs explained herein. For example the KDFs of stack 402 may include an outer blank substantially similar to outer blank 200 and an insert blank substantially similar to insert blank 300. Container erecting machine 400 may include a rotational guide 404, one or more claws 406, 408, a conveying track 410 and a control system (not shown). A holding claw 408 (best seen in FIG. 4B) may hold a portion of a KDF (for example a side panel) substantially in place while an opening claw 406 may grab another portion of the KDF (for example the rear panel) and move that portion such that the KDF transforms from its substantially flat orientation to a partially erected orientation.

To open the KDF, opening claw 406 may slide in a rotational manner along rotational guide 404, starting in the orientation shown in FIG. 4A (where the KDF is substantially flat) and ending in the orientation shown in FIG. 4B (where the KDF is substantially open and/or partially erected). Holding claw 408 may stay in substantially the same location throughout the opening process, although holding claw 408 may move a small distance to pull and/or engage the immediate KDF 412 from the stack 402 of KDFs. During the opening process, with the opening claw 406 sliding in a rotational manner and the holding claw 408 staying substantially in place, the moving claws 406, 408 may resemble the covers of an opening book, where the front cover moves in a rotational manner and the back cover stays substantially in place. During the opening process, the claws may partially erect the outer blank of the KDF 412, which automatically erects the insert blank of the KDF, as described herein, automatically creating corner posts/supports to the container.

As the claws 406, 408 partially erect the KDF 412, they may also lower the KDF onto a conveying track 410, as best seen in FIGS. 4B and 4C. Conveying track 410 may include components that complete the erection process by closing the bottom flaps 414, 416 of KDF 412, which converts the KDF into a completed container. Once the bottom flaps are closed, the conveying track 410 may move the completed container in a direction 418 away from the stack 402 of remaining KDFs. As the completed container moves away from the stack, the claws 406, 408 may grab and partially erect another KDF from the stack 402. This process of grabbing, erecting, and conveying away may repeat as long as there are KDFs remaining in stack 402 and/or as long as the container erecting machine 400 is activated.

The container erecting machine 400 may include a control system (not shown). The control system may direct the movement of components of the container erecting machine 400, for example one or more claws 406, 408 and/or one or more sub-components of a conveying track 410. The control system may include circuitry, one or more data processors, motors, wires, and/or other components common in mechanical systems.

The term "knocked down flat" (KDF) generally refers to a partially assembled container that is currently in a relatively flat configuration and is capable of being erected into a container adapted to hold goods. A KDF may include one or more blanks, where the one or more blanks may be adhered together at adhesion points. The terms "carton," "container," "display" and "box" may generally be used interchangeably to generally mean a structure, generally having a box shape, in which consumer goods and/or product may be shipped, transported and/or displayed to consumers in stores. Term "blank" generally means a flat sheet of some material, for example paperboard, that is ready to be folded into and become a portion of a container, or the whole container. The blanks and/or KDFs and/or containers of the embodiments described herein are typically manufactured using corrugated paperboard, for example with the corrugations running in a vertical direction for increased strength. As non-limiting examples, the containers may be manufactured from C-flute, EB-flute, E-flute or B-flute corrugated paperboard. It is to be understood that the principles of one or more embodiments of this disclosure may be applied to containers made of other materials, such as non-corrugated paperboards, cardboard, corrugated fiberboard, non-corrugated fiberboard, solid-fiber board, polymeric materials, and other foldable materials. It should also be understood that the principles of one or more embodiments of this disclosure may be applied to containers of varying styles, for example HSC-style containers or other styles of corrugated boxes or non-corrugated boxes.

In addition to the benefits of the preassembled display with automatic stackable supports already described in this disclosure, the following describes further benefits of one or more embodiments. It is to be understood that benefits and advantages described throughout this disclosure are not limitations or requirements, and some embodiments may omit or include more than one or more of the described benefits and/or advantages.

Customers, industry standards and the like may exhibit a preference for low cost, paperboard containers that provide structural stacking strength with a minimal amount of corrugated paperboard. Customers, industry standards and the like may exhibit a preference for a shipping container that is free of excessive structural elements. Existing displayable containers tend to be somewhat weak, and in certain situations they may deform when stacked. The preassembled display with automatic stackable supports may address these preferences.

Some prior HSC-style stackable displays have disadvantages. For example they may fashion stackable supports from folded sections of the outer display blank or may use multiple insert sections to reinforce corners of the container. These displays may suffer from disadvantages. For example, these displays may include bulky regions (too much material in an area) when the display is flattened which may make storage, shipping and interaction with an erecting machine less reliable. The excessive materials of these displays may also cause binding during erection of a KDF, which may cause less consistent and less reliably erecting. Some prior HSC-style stackable displays utilize symmetric supports located at opposing corners of the outer display blank. In these displays, there may be too much material (i.e., "bulk") in the corners, and when the container gets folded to form a KDF, the bulk in the corners may prevent the container from being flat. Some prior HSC-style stackable displays have been constructed by manually inserting end panels and/or corner posts to create the stackable supports. In some situations, end panels and/or corner posts are manually inserted after the outer box is erected. The manual and/or subsequent insertion of end panels and/or corner posts may result in higher costs, for example due to additional labor and/or equipment requirements. For example, the conversion (e.g., folding, erecting, etc.) may require additional workers to manually insert supports, which adds labor costs. Additionally, manual and/or subsequent insertion may require additional area (e.g., floor space) within a container production line to accommodate additional container components and additional equipment and workers. Some prior HSC-style stackable displays have required specialized container-erecting equipment beyond the standard equipment used by manufacturers to erect displays and/or containers that do not require subsequent insertion of supports. Further, in some situations, existing production lines have been decommissioned because they are not capable of supporting the assembly needs of containers that require manual and/or subsequent insertion of end panels and/or corner posts.

The preassembled display with automatic stackable supports may provide improved stackability with the efficiency of automatic erection of a single insert that provides corner supports. The display described herein eliminates the need to manually insert supports in the display during production. Existing stackable displays (for example, HSC-style stackable displays) may require manual insertion of inserts and/or supports, such as end panels. The display described herein includes stacking components (an insert blank) built into a pre-assembled KDF, which eliminates the need for manual placement. Existing stackable displays may either fashion stackable supports from folded sections of the display blank or use multiple insert sections to reinforce corners. The display described herein may use a single insert blank that may provide asymmetric corners when the KDF is erected. The asymmetric corner may offer improved stackability.

The display described herein may be erected using existing case erecting equipment to enable in-house production of display trays. Eliminating the need for manual placement of supports may result in a lower cost of conversion and may require less area within the production line for labor associates and packaging components. Manually inserting supports may be slow and expensive but such stackable containers may be required by retailers. Erection of the pre-assembled KDFs of the present disclosure does not require specialized case erecting equipment and may run on standard container erecting equipment that a good manufacturer may already utilize. This may be particularly valuable in that the implementation will not require additional capital investments nor an extended timeline prior to launching into market. This may remove incremental labor cost from conversion of KDFs. Eliminating the need for manual placement of supports may also enable reduction in the amount of floor space that a production line occupies. The containers and equipment described herein may enable production lines to be brought back into use, ones that were not initially capable of supporting displays that require manual insertion of supports. Allowing a goods manufacturer to get multiple uses out of a single case erecting equipment may give the manufacturer the flexibility of creating various cartons and only investing in one type of carton erecting machine. Some existing stackable displays cannot be erected by the same equipment because they require more complicated erection processes.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

The invention claimed is:

1. A preassembled display, comprising:

an outer blank including outside and inside surfaces; and an insert blank adhered to one or more of the inside surfaces of the outer blank at a plurality of adhesion zones, wherein the plurality of adhesion zones includes at least one fast curing adhesion zone and at least one slow curing adhesion zone, wherein the insert blank is adapted to automatically erect when the outer blank is erected, wherein the insert blank is adapted to form a plurality of supports located at corners of the outer blank automatically when the outer blank is erected, wherein the plurality of supports comprises a first support located at a first corner of the outer blank and a second support located at a second corner of the outer blank, wherein the first corner and the second corner are diagonally opposed to each other, wherein the first and second supports are asymmetrically shaped when compared to each other.

2. The preassembled display of claim 1 wherein the plurality of supports comprises a fourth support located at a fourth corner of the outer blank.

3. The preassembled display of claim 2 wherein the fourth support is asymmetrically shaped when compared to the first support.

4. The preassembled display of claim 3 wherein each of the plurality of supports includes one or more support panels, wherein at least two of the plurality of supports include a different number of support panels and/or wherein at least two of the plurality of supports include differently sized support panels and/or wherein at least two of the plurality of supports include support panels with different angles at the joints near the support panels.

5. The preassembled display of claim 1 wherein the insert blank nests or wraps inside the outer blank such that the insert blank substantially abuts the inside of the outer blank.

6. The preassembled display of claim 5 wherein the insert blank nests or wraps along less than the entire inside of the outer blank.

7. The preassembled display of claim 1 wherein the insert blank is formed from a single piece of corrugated paperboard.

8. The preassembled display of claim 1 wherein the at least one fast curing adhesion zone includes a hot melt adhesive.

9. The preassembled display of claim 1 wherein the slow curing adhesion zone includes a cold melt adhesive.

10. The preassembled display of claim 1 wherein the at least one fast curing adhesion zone includes a hot melt adhesive.

11. The preassembled display of claim 1 wherein the outer blank includes a front panel, a rear panel, two side panels, and a connection panel; and includes a front flap, a rear flap, and two side flaps.

12. The preassembled display of claim 1 wherein the insert blank includes a front panel, two side panels, and one or more support panels; and includes a bottom flap.

13. The preassembled display of claim 1 wherein the outer blank and the insert blank each include one or more perforated joints, wherein the perforated joints: adapt the preassembled display to be assembled into a substantially flat knocked down configuration, and adapt the preassembled display to be erected from the substantially flat knocked down configuration into a container.

14. The preassembled display of claim 13 wherein the adhesion zones are strategically located such that when the outer blank is erected, the outer blank pulls and/or pushes the insert blank at the adhesion zones, forcing the insert blank to automatically erect.

15. The preassembled display of claim 11 wherein the plurality of adhesion zones include multiple adhesion zones on the front panel of the outer blank, multiple adhesion zones on one side panel of the outer blank, and one adhesion zone on the rear panel of the outer blank.

16. The preassembled display of claim 15 wherein the multiple adhesion zones on the front panel of the outer blank include a fast curing adhesive.

17. The preassembled display of claim 16 wherein the fast curing adhesive is a hot melt adhesive.

18. The preassembled display of claim 15 wherein the multiple adhesion zones on one side panel of the outer blank include a slow curing adhesive.

19. The preassembled display of claim 18 wherein the slow curing adhesive is a cold melt adhesive.

20. The preassembled display of claim 15 wherein the one adhesion zone on the rear panel of the outer blank includes a slow curing adhesive.

21. The preassembled display of claim 20 wherein the slow curing adhesive is a cold melt adhesive.

22. The preassembled display of claim 15 wherein the multiple adhesion zones on the front panel of the outer blank include a fast curing adhesive and wherein the multiple adhesion zones on one side panel of the outer blank include a slow curing adhesive.

23. The preassembled display of claim 15 wherein the multiple adhesion zones on the front panel of the outer blank include a fast curing adhesive and wherein the one adhesion zone on the rear panel of the outer blank includes a slow curing adhesive.

24. The preassembled display of claim 15 wherein the multiple adhesion zones on one side panel of the outer blank include a slow curing adhesive and wherein the one adhesion zone on the rear panel of the outer blank includes a slow curing adhesive.

25. The preassembled display of claim 24 wherein the multiple adhesion zones on the front panel of the outer blank include a fast curing adhesive.

26. The preassembled display of claim 1 wherein at least one of the plurality of supports extends substantially the entire height of the outer blank.

27. A preassembled display, comprising:

an outer blank including outside and inside surfaces; and an insert blank including outside and inside surfaces, wherein the insert blank is adapted to automatically erect when the outer blank is erected, wherein the insert blank is adapted to form a plurality of supports located at corners of the outer blank automatically when the outer blank is erected, wherein the plurality of supports comprises a first support located at a first corner of the outer blank, a second support located at a second corner of the outer blank and a third support located at a third corner of the outer blank, wherein the first corner and the second corner are diagonally opposed to each other, and wherein the first, second and third supports are asymmetrically shaped when compared to each other.

28. The preassembled display of claim 27 wherein the plurality of supports comprises a fourth support located at a fourth corner of the outer bank.

29. The preassembled display of claim 28 wherein the fourth support is asymmetrically shaped when compared to the first support.

* * * * *